US009322236B2

(12) United States Patent
Arslan et al.

(10) Patent No.: US 9,322,236 B2
(45) Date of Patent: Apr. 26, 2016

(54) CORING SYSTEM AND METHOD

(71) Applicants: Haydar Arslan, Spring, TX (US); Patrick C. Wong, Cypress, TX (US); Trevor A. Curry, Calgary (CA)

(72) Inventors: Haydar Arslan, Spring, TX (US); Patrick C. Wong, Cypress, TX (US); Trevor A. Curry, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 14/630,522

(22) Filed: Feb. 24, 2015

(65) Prior Publication Data

US 2015/0285020 A1 Oct. 8, 2015

Related U.S. Application Data

(60) Provisional application No. 61/975,529, filed on Apr. 4, 2014.

(51) Int. Cl.

| | |
|---|---|
| ***E21B 25/18*** | (2006.01) |
| ***E21B 7/12*** | (2006.01) |
| ***E21B 25/00*** | (2006.01) |

(52) U.S. Cl.

CPC . *E21B 25/18* (2013.01); *E21B 7/12* (2013.01); *E21B 25/00* (2013.01)

(58) Field of Classification Search

CPC ..... E21B 25/18; E21B 7/124; E21B 25/00; E21B 25/02; E21B 25/14

USPC ..... 175/6, 7, 20, 58, 67.244, 308; 37/307, 37/317, 320, 346; 405/224, 228

See application file for complete search history.

(56) References Cited

U.S. PATENT DOCUMENTS

| | | | | |
|---|---|---|---|---|
| 4,234,046 | A * | 11/1980 | Haynes | 175/6 |
| 6,394,192 | B1 | 5/2002 | Frazer | |
| 7,918,287 | B2 | 4/2011 | Foley | |
| 2008/0179091 | A1 * | 7/2008 | Foley | 175/7 |
| 2010/0021241 | A1 | 1/2010 | Thomas et al. | |

FOREIGN PATENT DOCUMENTS

| | | |
|---|---|---|
| EP | 1 671 769 | 6/2006 |

* cited by examiner

*Primary Examiner* — James G Sayre

(74) *Attorney, Agent, or Firm* — ExxonMobil Upstream Research-Law Department

(57) ABSTRACT

A system and method for obtaining soil samples is described. A coring system includes a suction carrier, a pump and a corer. The suction carrier comprises a body defining a cavity and a top portion having an aperture. The pump is positioned adjacent to the aperture and constructed and arranged to deliver fluid from the cavity. The corer is constructed and arranged to releasably engage with the suction carrier.

18 Claims, 9 Drawing Sheets

CORING SYSTEM AND METHOD

CROSS-REFERENCE TO RELATED APPLICATION

This application claims the benefit of U.S. Provisional Application No. 61/975,529, filed Apr. 4, 2014, the entirety of which is incorporated by reference herein.

FIELD OF INVENTION

This invention generally relates to devices and methods for obtaining seabed or soil samples.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Deep-water geotechnical site investigation is a cost intensive activity. A conventional rotary soil boring has been the primary method used to acquire geotechnical data since the first borings were drilled. Using conventional techniques, the borehole is advanced by a drill bit and downhole samples are acquired using a wireline sampler lowered down the bore of the drill pipe. Due to high cost and potential sample quality concerns of the conventional rotary drilling, operators are continuously evaluating more economical options for acquiring high quality soil data.

Jumbo Piston Corers (JPC) are a relatively recent innovation. These devices allow for continuous large diameter piston cores to be taken to depths up to 30 meters in deep water environment. However, due to soil resistance, 30 meter penetration is rare.

Thus, there is a need for improvement in this field.

SUMMARY OF THE INVENTION

The present invention provides suction embedded coring system and methods of utilizing the same.

One non-limiting example of the present disclosure is a coring system comprising a suction carrier comprising a body defining a cavity and a top portion having an aperture; a pump positioned adjacent to the aperture and constructed and arranged to deliver fluid from the cavity; and a corer constructed and arranged to releasably engage with the suction carrier.

The foregoing has broadly outlined the features of one non-limiting example of the present disclosure in order that the detailed description that follows may be better understood. Additional features and embodiments will also be described herein.

BRIEF DESCRIPTION OF THE DRAWINGS

The present invention and its advantages will be better understood by referring to the following detailed description and the attached drawings.

Figure 1:
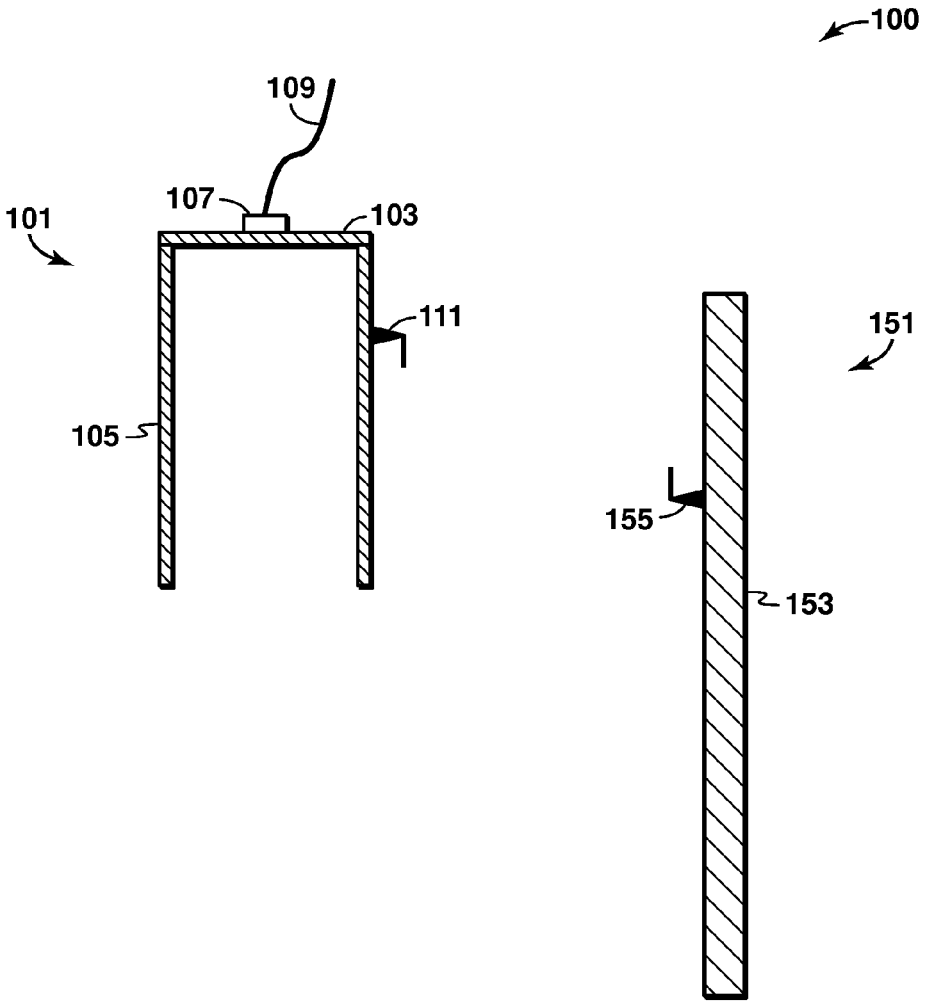
FIG. 1 is a side, cross-sectional view of a coring system according to one non-limiting example of the present disclosure.

It should be noted that the figures are merely examples of several embodiments of the present invention and no limitations on the scope of the present invention are intended thereby. Further, the figures are generally not drawn to scale, but are drafted for purposes of convenience and clarity in illustrating various aspects of certain embodiments of the invention.

DESCRIPTION OF THE SELECTED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One non-limiting example of the invention is shown in great detail, although it will be apparent to those skilled in the relevant art that some features that are not relevant to the present invention may not be shown for the sake of clarity.

Due to high cost and dedicated geotechnical drillship availability concerns of the conventional rotary drilling, operators are continuously evaluating more economical options for acquiring high quality soil data. The proposed designs set forth in the present disclosure describe a new technology to reduce offshore geotechnical site investigation scope and cost by modifying the existing corers concepts as well as obtain longer and continuous soil samples.

Figure 6:
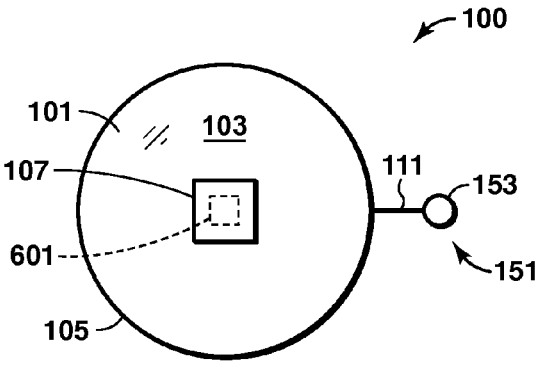
FIG. 6 is a top plan view of the coring system depicted in FIG. 3.

FIG. 1 is a side, cross-sectional view of a coring system 100 according to one non-limiting example of the present disclosure. As depicted, coring system 100 includes a suction carrier 101 and a corer 151 (coring member). Suction carrier 101 is comprised of a body 105 and a top portion 103. In order to generate the differential pressure required to install or remove the suction carrier body 105 into or from the seabed (or other soil), a pump 107 is positioned adjacent to top portion 103. Pump 107 is constructed and arranged to pump fluid either into or from the area interior to the carrier body 105. As depicted in FIG. 6 and discussed herein below, top portion 103 has at least one opening or aperture which allows pump 107 to deliver fluid (such as, but not limited to, water) to and from the interior of carrier body 105. Pump 107 may be controlled through a variety of known techniques. In the depicted non-limiting example, a control umbilical 109 is provided to operate and control pump 107. In other non-limiting embodiments, pump 107 may be operated by a remotely operated vehicle or through a wireless control system. An engagement member 111 is also provided on the exterior of body 105.

Corer 151 is comprised of a body 153 and an engagement member 155 provided on the exterior of body 153. In the depicted examples, body 153 has a substantially circular cross-section, though other geometries are within the scope of the present disclosure. At least one corer barrel is provided within body 153. Conventional corer barrels essentially consist of cylindrical members having a sharp leading edge and a core catcher which maintains the core, or sample, within the corer barrel when the corer is removed from the soil. The number and arrangement of corer barrels within corer 151 can depend on application and design objectives.

The suction carrier 101 and corer 151 can be deployed from a vessel floating on the water surface. The suction carrier 101 and corer 151 can be mechanically tethered to the floating vessel. Engagement members 111, 155 can be attached to carrier body 105 and corer body 153, respectively, through known techniques. Engagement members 111, 155 can take a variety of forms, such as, but not limited to, latching devices.

Figure 2:
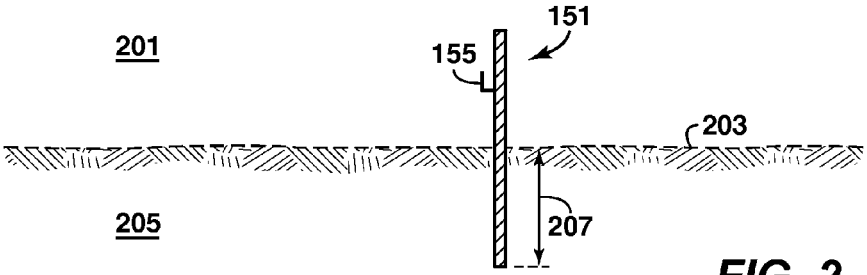
FIG. 2 is a side, cross-sectional view of a corer embedded into the seabed.

FIG. 2 is a side, cross-sectional view of a corer 151 embedded into the subsea soil 205. As appreciated by those skilled in the art, the corer 151 has been deployed from a vessel and placed into a body of water 201 using known techniques. The corer 151 is then lowered onto the seafloor 203 and into place where a subsea soil sample is to be taken. As appreciated by those skilled in the art, corer 151 can be any conventional corer, such as but not limited to, JPC, differential pressure corer, etc. In the depicted example, the distal end of corer 151 has extended into the subsea soil 205 to a first depth 207. Of note, engagement member 155 is positioned above the seafloor.

The first depth can be in the range of, but not limited to, 15-20 meters. In some non-limiting examples, the length of corer 151 is longer (greater) than the length of carrier body 105.

Figure 3:
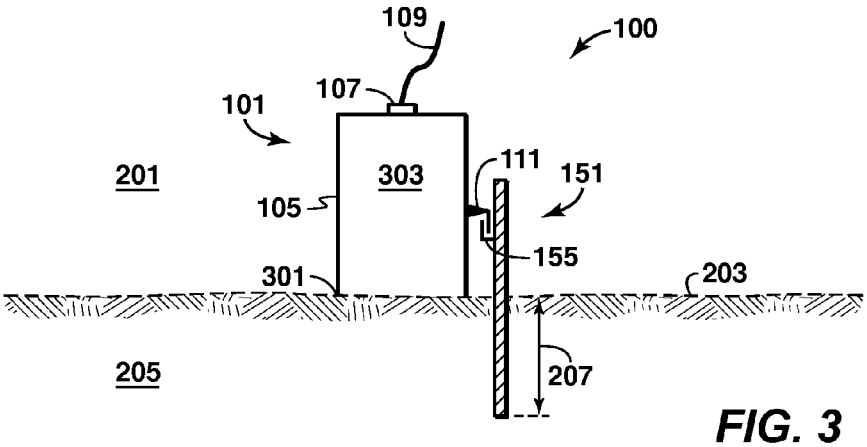
FIG. 3 is a side, cross-sectional view of a coring system e in which a suction carrier is positioned next to a corer on the seafloor.

FIG. 3 is a side, cross-sectional view of a coring system 100 according to one non-limiting example of the present disclosure in which a suction carrier 101 is positioned next to the corer 151 on the seafloor 203. When the suction carrier 101 is lowered onto the seafloor 203, the lower rim 301 of the carrier body 105 will cut into the seabed soil 205, thereby creating a seal between the carrier and the seafloor. However, the weight of the carrier body itself is insufficient to completely drive the carrier into the seabed soil 205.

As depicted, the engagement member 111 of suction carrier 101 has also been positioned to align with engagement member 155 of corer 151. Engagement members 111, 155 allow for releasable engagement between suction carrier 101 and corer 151. Engagement members 111, 155 can be configured to engage and lock such that any upward and downward force provided by suction carrier 101 is transferred to corer 151. Engagement members can also be configured such that the mechanical engagement between members 111, 155 will only allow the suction carrier 101 to provide downward force on corer 151. In either configuration, the alignment of engagement members 111, 155 enables any downward force from suction carrier 101 to be applied to carrier 151.

Figure 4:
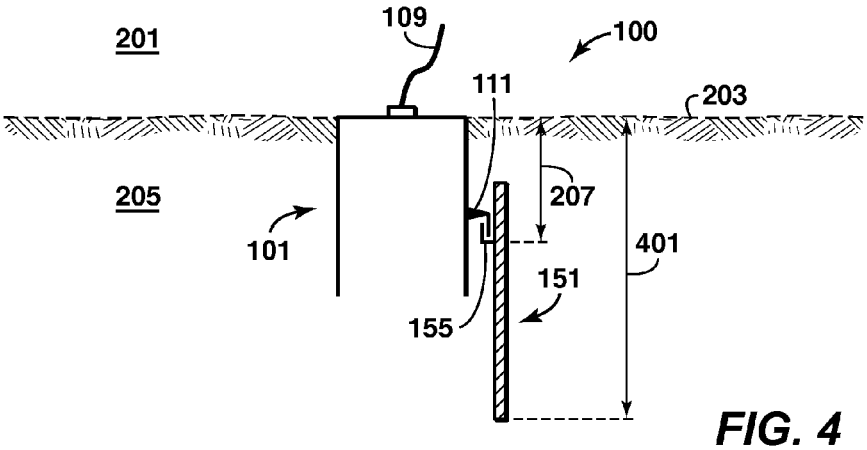
FIG. 4 a side, cross-sectional view of the coring system depicted in FIG. 3 in which the suction carrier has driven the corer into the seabed.

In order to drive corer 151 further into the subsea soil 205, a suction force is then applied to the suction carrier 105, and in turn to corer 151, by pumping out the water enclosed within the carrier cavity 303. The differential pressure between the top of the carrier and within cavity 303 drives the carrier body 105 into the seabed soil 205. FIG. 4 a side, cross-sectional view of the coring system 100 depicted in FIG. 3 after the suction carrier 101 has driven the corer 151 further into the seabed 205. As depicted, the distal end of corer 151 has now been penetrated to a second depth 401. The difference between the first depth 207 and the second depth 401 is the amount that the suction carrier 101 has been embedded into the subsea soil 205.

The second phase of penetration can be an additional 25-40 meters, though different penetration depths can be achieved based on suction carrier design, soil type, and other factors. The second depth can be in the range of, but not limited to, 40-60 meters. In such non-limiting examples, 45-60 meter continuous soil sampling can be achieved.

Figure 5:
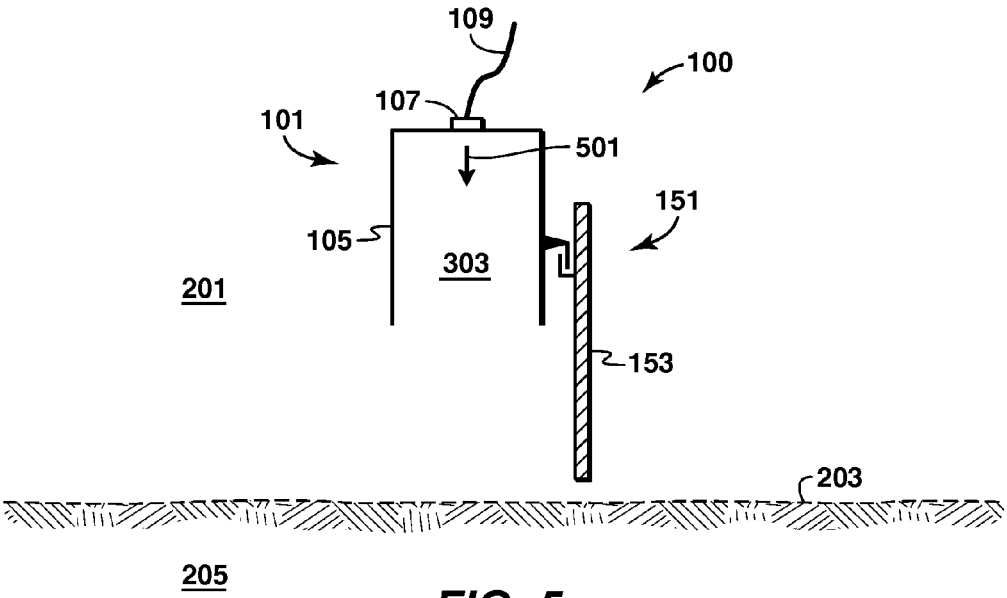
FIG. 5 is a side, cross-sectional view of the coring system depicted in FIG. 4 being retrieved from the seabed.

FIG. 5 is a side, cross-sectional view of the coring system 100 depicted in FIG. 4 being retrieved from the seabed soil 205. In the depicted example, the coring system 100 is removed from the seabed soil 205 by producing positive pressure within cavity 303. This is achieved by operating pump 107 to pump fluid 501 into cavity 303. Because of the engagement between suction carrier 101 and corer 151, both objects are lifted out of the seabed soil 205. Once the suction carrier 101 is removed, the system 100 is retrieved by mechanical means, such as, but not limited to, a tether. In other examples, suction carrier 101 and corer 151 can be retrieved from the seabed soil 205 separately.

FIG. 6 is a top plan view of the coring system 100 depicted in FIG. 3. The suction carrier 101 and the corer 151 are located adjacent to one another and are connected via engagement members 111, 155 (not shown). Carrier body 105 and corer body 153 are shown as having a circular geometry, though other geometries may be utilized. A plurality of corer barrels can be provided within corer body 153 in order to house the obtained soil sample, though they are not depicted.

Again, in order to generate the differential pressure required to install/remove the suction carrier body 105 into/from the seabed (or other soil), pump 107 is positioned adjacent to top portion 103 and is configured to pump fluid either into or out of the area interior to the carrier body 105. Top portion 103 has at least one opening or aperture 601 which allows pump 107 to deliver fluid to and from the interior of carrier body 105.

Figure 7:
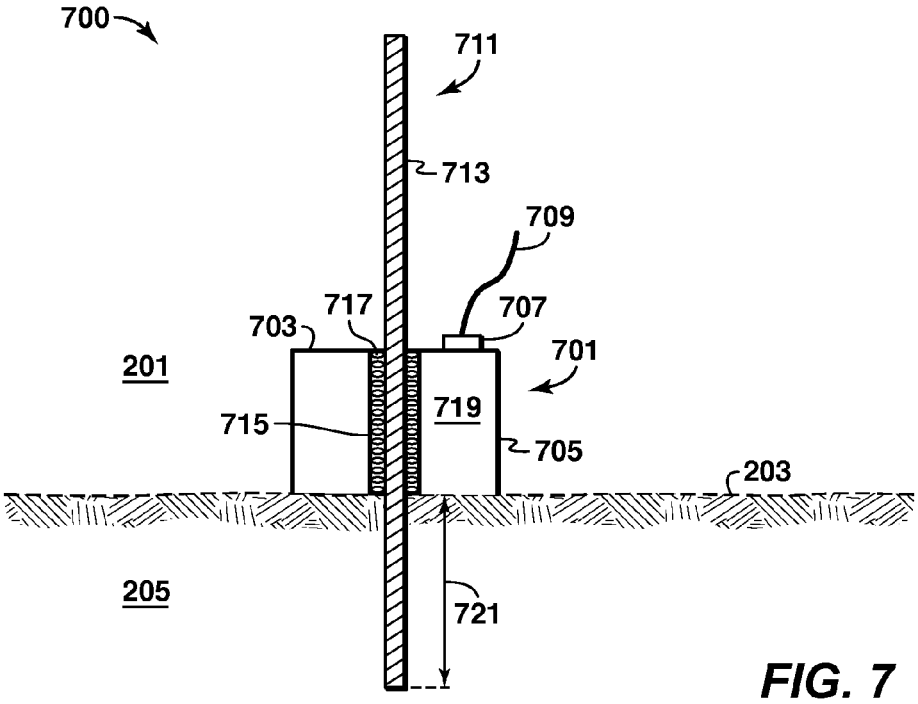
FIG. 7 is a side, cross-sectional view of a coring system according to another non-limiting example of the present disclosure in which the coring system is in a first position.

FIG. 7 is a side, cross-sectional view of a coring system 700 according to another non-limiting example of the present disclosure. As depicted, coring system 700 includes a suction carrier 701 and a corer 711. Suction carrier 701 is comprised of a body 705 and a top portion 703. A pump 707 is positioned adjacent to top portion 703. Pump 707 is configured to pump fluid into/from the area interior to the carrier body 705. Top portion 703 has at least one aperture which allows pump 707 to deliver fluid (such as, but not limited to, water) to and from the interior of carrier body 705. Pump 707 may be controlled through a variety of known techniques. In the depicted non-limiting example, a control umbilical 709 is provided to operate and control pump 707.

As depicted in FIG. 7, corer 711 is concentrically located within suction carrier 701. Corer 711 can be equipped with conventional equipment similar to the equipment described with respect to corer 151. More specifically, corer body 713 is concentrically positioned within an internal pipe 715 which is disposed within carrier body 705. In FIG. 7, internal pipe 715 extends the entire length of carrier body 705. However, internal pipe 715 can be shorter.

An inflatable seal 717 is disposed between the interior of internal pipe 715 and the portion of the exterior of corer 711 positioned within internal pipe 715. Though an inflatable seal is depicted, any actuatable sealing device may be used. In order to create the necessary pressure differential to embed or remove the suction carrier 701 into or out of the sea bed soil 205, the inflatable seal 715 can provide a fluid seal between the carrier cavity 719 and the surrounding water 201. The inflatable seal 715 can also provide a releasable mechanical or physical engagement between corer 711 and suction carrier 701. Inflatable seal 717 can receive air pressure from pump 707 or from a separate pump. In other non-limiting examples, inflatable seal 717 can be replaced by a hydraulic clamp or other device.

Figure 8:
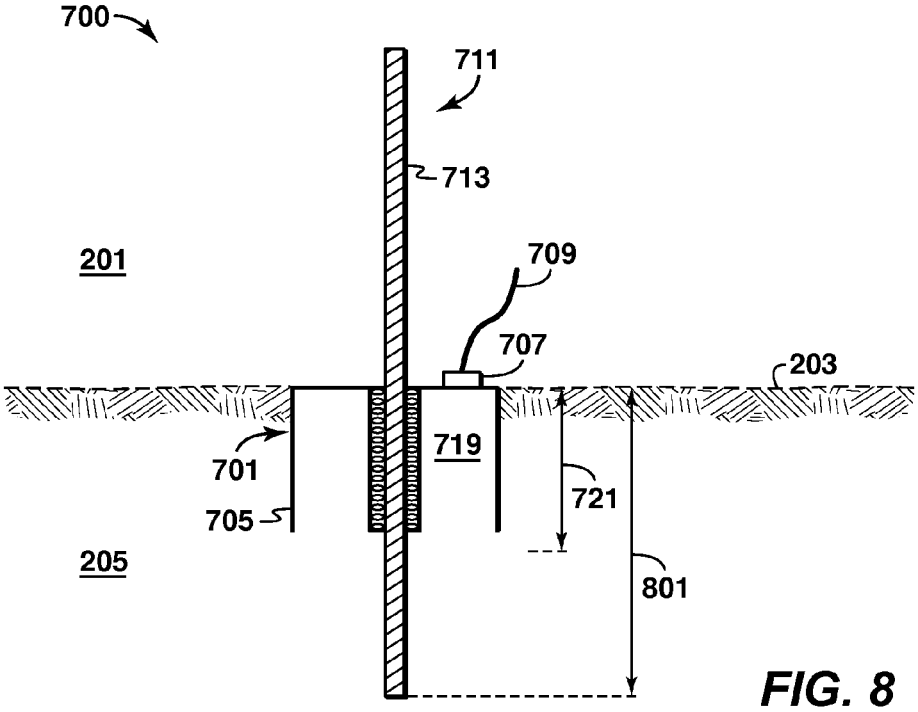
FIG. 8 is a side, cross-sectional view of the coring system depicted in FIG. 7 in which the coring system is in a second position.

In the configuration depicted in FIG. 7, the distal end of corer 711 has been driven into the seabed soil 205 to a first depth 721. In order to drive corer 711 further into the subsea soil 205, a suction force is then applied to the suction carrier 701, and in turn to corer 711, by pumping out the water enclosed within the carrier cavity 719 through operation of pump 707. The differential pressure between the top of the carrier and within cavity 719 drives the carrier body 705 into the seabed soil 205. FIG. 8 is a side, cross-sectional view of the coring system 700 in which the suction carrier 701 has been driven into the seabed soil 205. As shown, the distal end of corer 711 has now been penetrated to a second depth 801. The difference between the first depth 721 and the second depth 801 is the amount that the suction carrier 701 has been embedded into the subsea soil 205.

Figure 9:
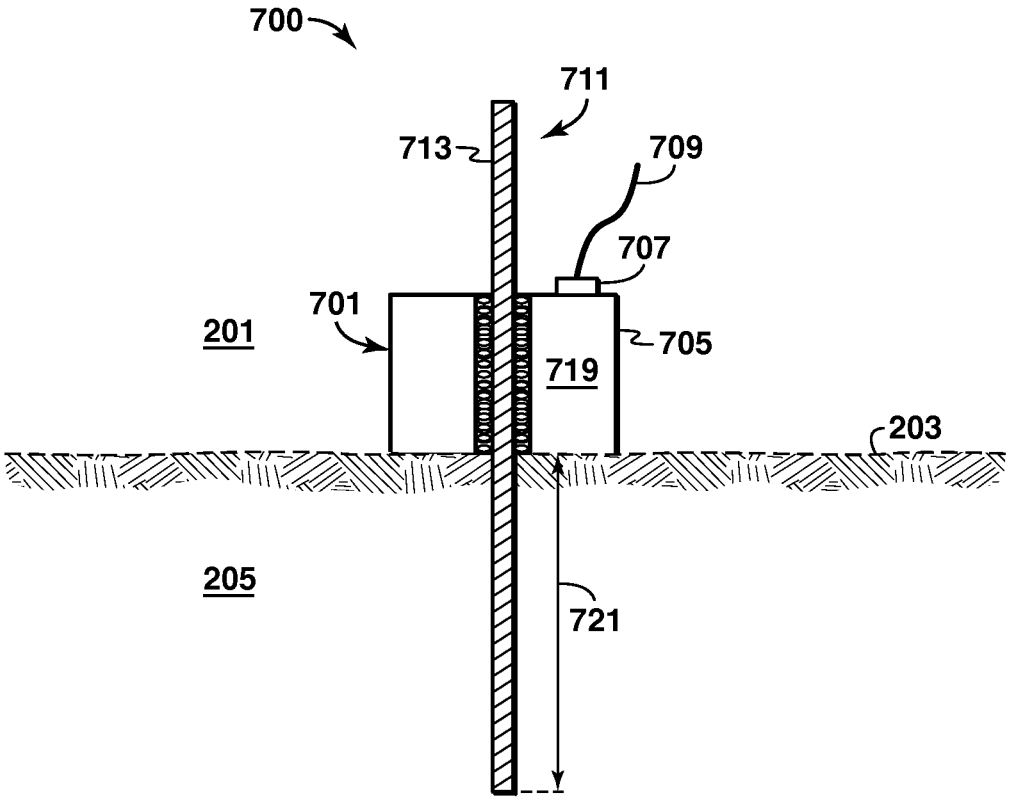
FIG. 9 is a side, cross-sectional view of the coring system depicted in FIG. 7 in which the coring system is in a third position.

Coring system 700 allows for the corer 711 to be driven further into the seabed soil 205 in a ratcheting-like manner. By releasing the engagement between the suction carrier 701 and corer 711, the carrier body 705 can then move freely in the vertical directly without affecting the depth of corer 711. By reverse operation of pump 707 or through other mechanical means, the suction carrier 701 can be raised or lifted out of the seabed soil 205 and allowed to come to rest on the seafloor 203. Such a configuration is depicted in FIG. 9.

Figure 10:
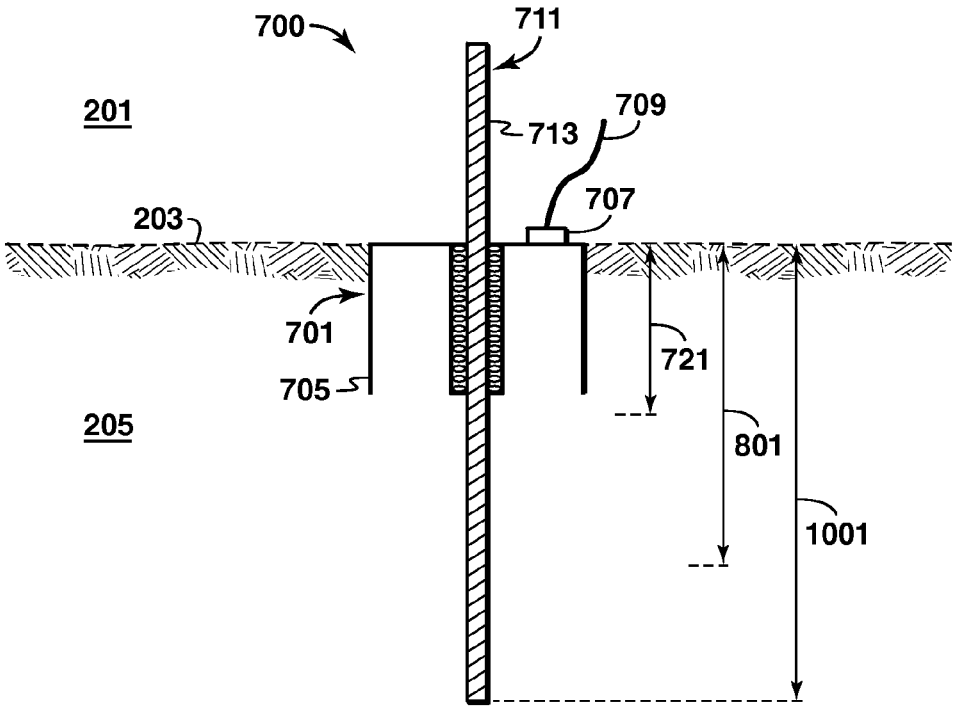
FIG. 10 is a side, cross-sectional view of the coring system depicted in FIG. 7 in which the coring system is in a fourth position.

In order to drive corer 711 even further into the subsea soil 205, the inflatable seal 717 is again engaged, thereby reestablishing the physical engagement between the carrier 701 and the corer 711, and the pump 707 is operated to pump water from carrier cavity 719. The generated differential pressure will drive the suction carrier 701 and corer 711 into the subsea soil 205. FIG. 10 is a side, cross-sectional view of the coring system 700 in which the suction carrier 701 has again been driven into the seabed soil 205. As shown, the distal end of corer 711 has now been penetrated to a third depth 1001. The difference between the second depth 801 and the third depth 1001 is the amount that the suction carrier 701 was been embedded into the subsea soil 205.

Once the corer has reached the necessary depth, the corer system 700 can be retrieved through operation of pump 707 or through mechanical means. The suction carrier 701 and the corer 711 can be retrieved together or individually.

The penetration depths achieved by the suction carrier can be in the range of, but are not limited to, 25-40 meters. In some non-limiting examples, continuous soil sampling can be achieved up to 80 meters.

Figure 11:
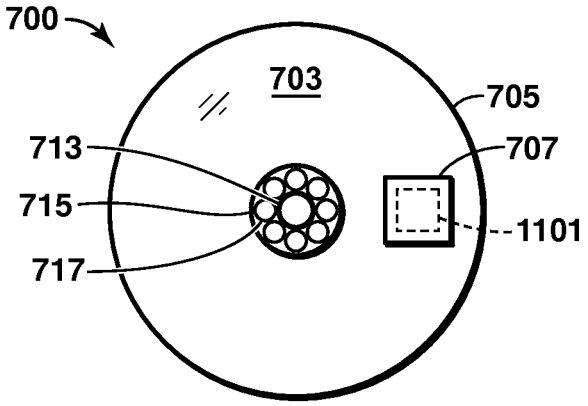
FIG. 11 is a top plan view of the coring system depicted in FIG. 7.

FIG. 11 is a top plan view of the coring system 700 depicted in FIG. 7. The internal pipe 715 is concentrically disposed within suction carrier body 705. Corer body 713 is concentrically disposed within internal pipe 715. Inflatable seal 717 is positioned between the interior of internal pipe 715 and the exterior of corer body 713. Carrier body 705, corer body 713 and internal pipe 715 are shown as having a circular geometry, though other geometries may be utilized. Again, in order to generate the differential pressure required to install or remove the suction carrier body 705 into or from the seabed (or other soil), pump 707 is positioned adjacent to top portion 703 and is configured to pump fluid either into or from the area interior to the carrier body 705. Top portion 703 has at least one opening or aperture 1101 which allows pump 707 to deliver fluid to and from the interior of carrier body 705.

Figure 12:
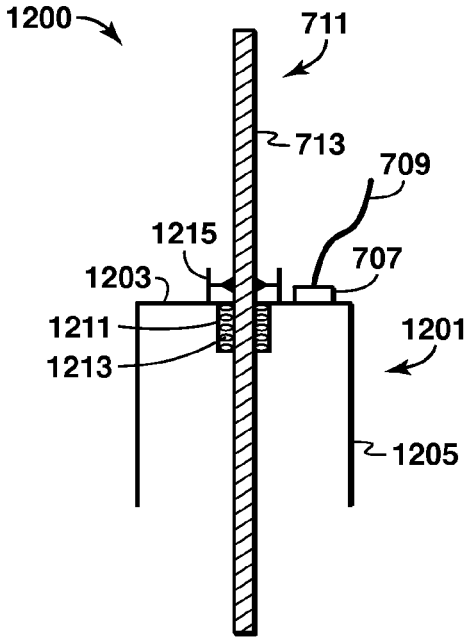
FIG. 12 is a side, cross-sectional view of a coring system according to a further non-limiting example of the present disclosure.

FIG. 12 is a side, cross-sectional view of a coring system 1200 according to a further non-limiting example of the present disclosure. In many respects, coring system 1200 is similar to coring system 700 described above. Similar features utilize similar reference numerals. As depicted, coring system 1200 includes a suction carrier 1201 and a corer 711. Suction carrier 1201 is comprised of a body 1205 and a top portion 1203. A pump 707 is positioned adjacent to top portion 1203.

Like coring system 700, coring system 1200 has a corer 711 which is concentrically located within suction carrier 1201. More specifically, corer body 713 is positioned within an internal pipe 1211 which is concentrically disposed within carrier body 1205. Unlike coring system 700 depicted in FIG. 7, internal pipe 1211 only partially extends down into carrier body 705. An inflatable seal 1213 is disposed between the interior of internal pipe 1211 and the portion of the exterior of corer body 713 positioned within internal pipe 1211. The inflatable seal 1213 provides a fluid seal between the carrier cavity and the surrounding fluid.

A clamp member 1215 is also attached to the top portion 1203 of the suction carrier. Clamp member 1215 can be actuated between an engaged and a dis-engaged position. FIG. 12 depicts clamp member in its engaged position. When in the engaged positioned, the clamp member 1215 mechanically engages the exterior of corer body 713. For example, when the corer 711 is to be driven downward by the suction carrier 1201 (through operation of pump 707), the clamp member 1215 is in its engaged position such that any downward force provided by the suction carrier 1201 is applied to corer 711. However, when the suction carrier 1201 is to freely move with respect to corer 711, clamp member 1215 is placed in its dis-engaged position. Clamp member 1215 can be controlled through known techniques, such as, but not limited to, communications provided by control umbilical 709, a remotely operated vehicle or through a wireless control system.

Figure 13:
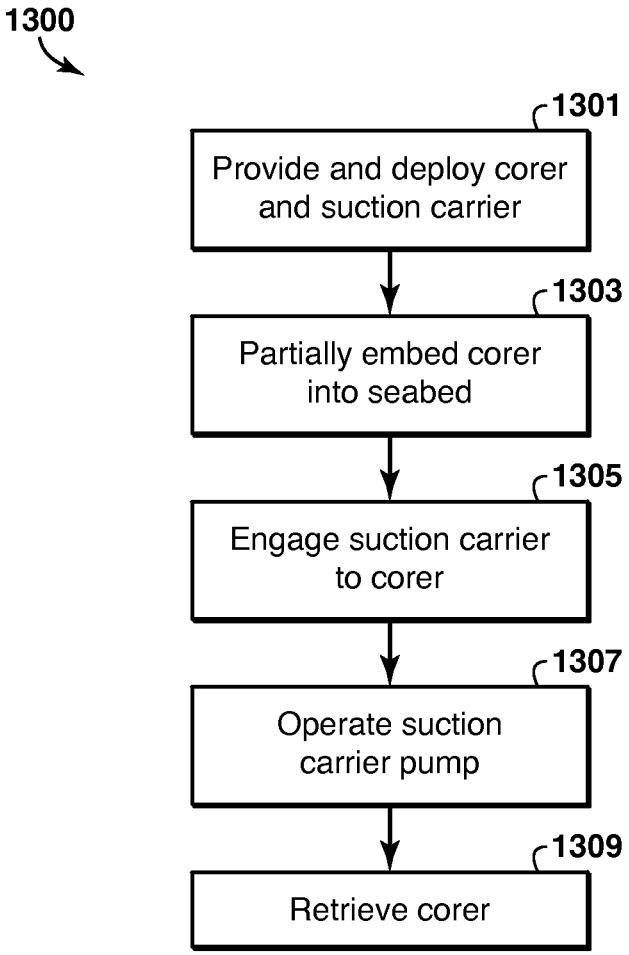
FIG. 13 is a flowchart depicting the basic steps of obtaining a core sample according to one non-limiting example of the present disclosure.

FIG. 13 is a flowchart depicting the basic steps of obtaining a core sample according to one non-limiting example of the present disclosure. Process 1300 begins by providing and deploying a corer apparatus and a suction carrier (step 1301). The corer and suction carrier can be deployed from a vessel using known techniques. Next, the corer is partially embedded into the seabed (step 1303). The corer can be any known corer apparatus. In one example, the corer is a JPC. At step 1305, the suction carrier is engaged to the corer. The suction carrier can be fixedly or releasably engaged to the corer. The suction carrier can be engaged to the corer mechanically, electromagnetically, or through other mechanisms or techniques.

In order to drive the suction carrier into the seabed, the suction carrier pump is operated to create the necessary pressure differential (step 1307). Once the corer has reached a suitable depth, the corer and the soil sample contained therein can be retrieved (step 1309). The corer and the suction carrier can be retrieved through known techniques. The corer and suction carrier can be retrieved together or independently.

Figure 14:
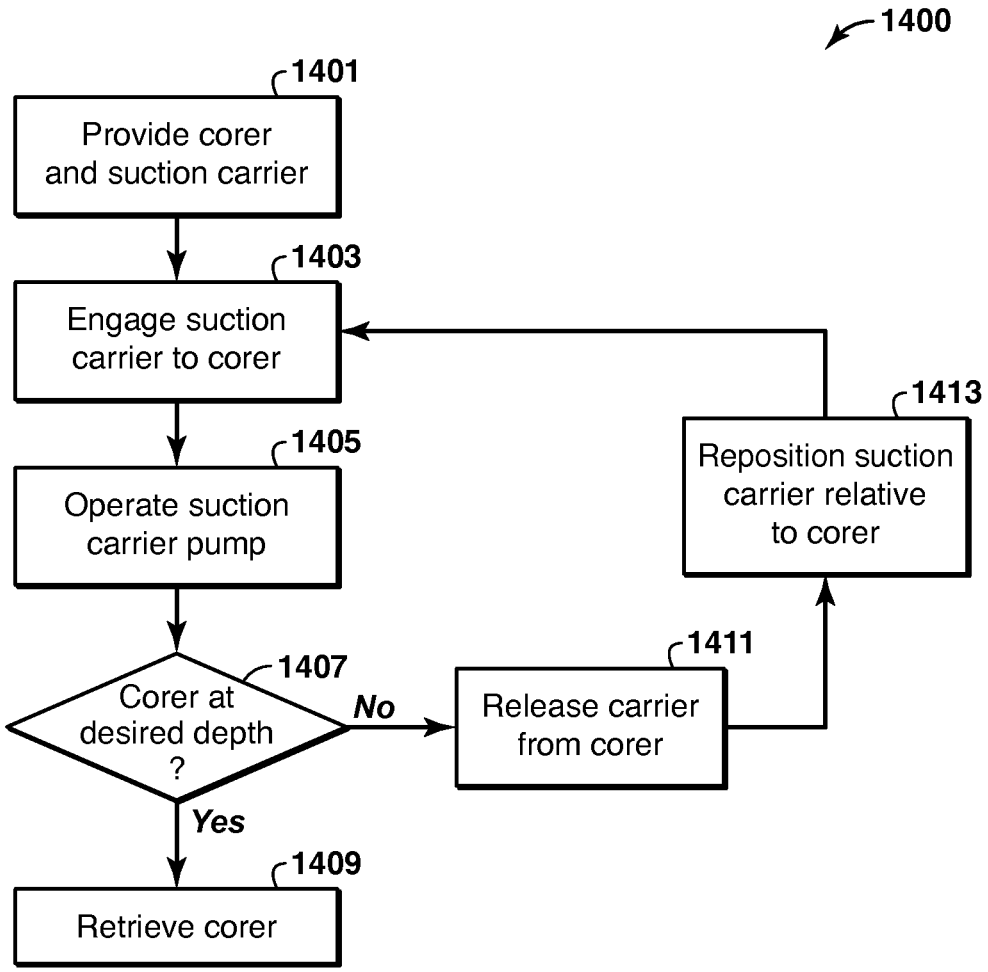
FIG. 14 is a flowchart depicting the basic steps of obtaining a core sample according to another non-limiting example of the present disclosure.

FIG. 14 is a flowchart depicting the basic steps of obtaining a core sample according to another non-limiting example of the present disclosure. Process 1400 begins by providing and deploying a corer apparatus and a suction carrier (step 1401). The corer and suction carrier can be deployed from a vessel using known techniques. At step 1403, the suction carrier is engaged to the corer. Though not depicted, the corer can be partially embedded into the seabed through known techniques.

In order to drive the suction carrier into the seabed, the suction carrier pump is operated to create the necessary pressure differential (step 1405). Next, the corer depth is evaluated and it is determined whether the necessary depth has been achieved (step 1407). If the desired depth has been achieved, then the corer is retrieved (step 1409). The corer and suction carrier can be retrieved together or independently.

However, if the desired depth has not been achieved, the suction carrier is released from the corer (step 1411). The suction carrier is then repositioned relative to the corer (step 1413). The process then continues back at step 1403. Process 1400 allows for the corer to be driven further into the seabed with each repositioning and operation of the suction carrier.

While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional blocks not shown herein. While the figures illustrate various actions occurring serially, it is to be appreciated that various actions could occur in series, substantially in parallel, and/or at substantially different points in time.

Figure 15:
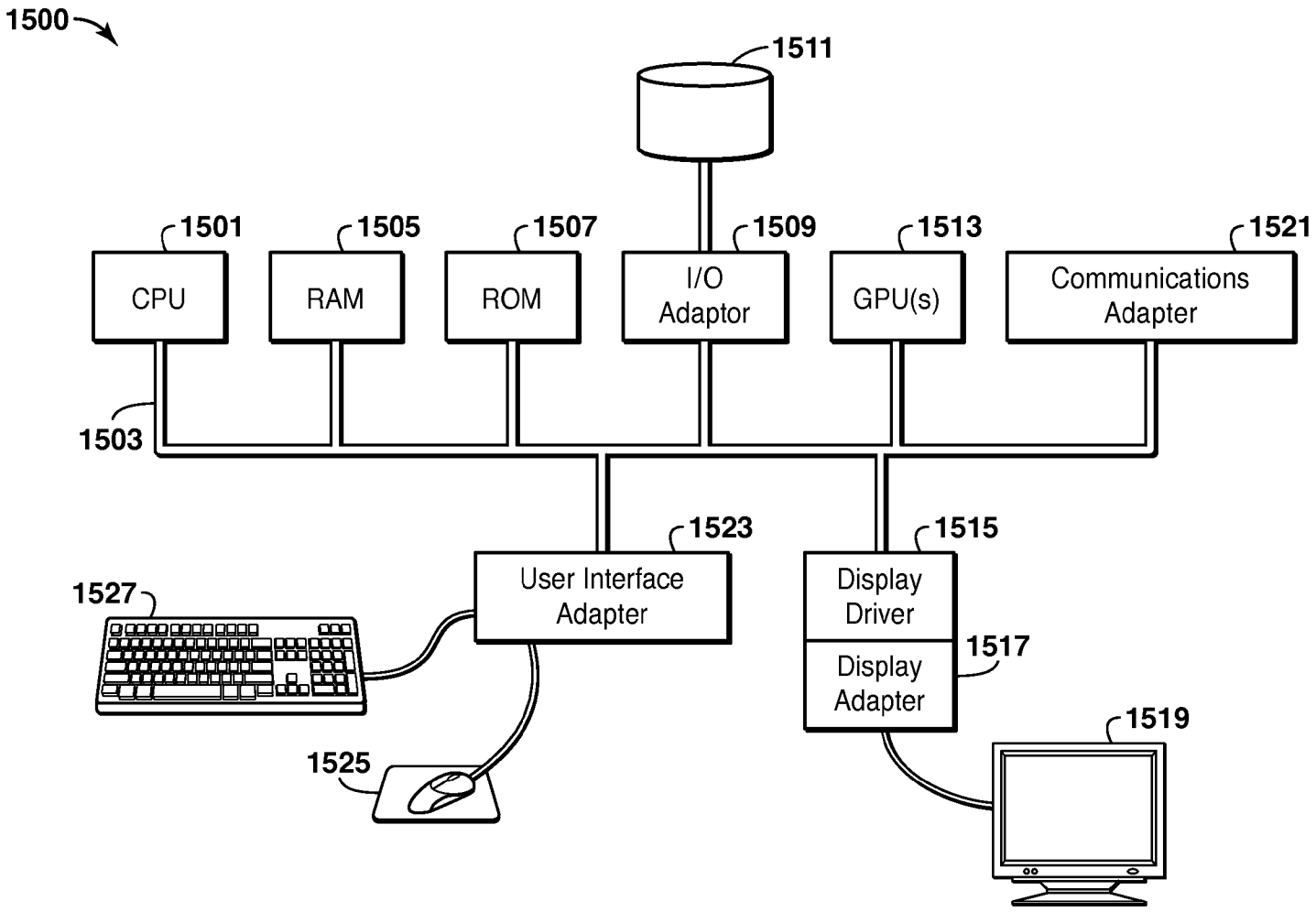
FIG. 15 is a block diagram of a computer system.

FIG. 15 is a block diagram of a computer system 1500 that can be used to execute a non-limiting example of the present techniques. A central processing unit (CPU) 1501 is coupled to system bus 1503. The CPU 1501 may be any general-purpose CPU, although other types of architectures of CPU 1501 (or other components of exemplary system 1500) may be used as long as CPU 1501 (and other components of system 1500) supports the operations as described herein. Those of ordinary skill in the art will appreciate that, while only a single CPU 1501 is shown in FIG. 15, additional CPUs may be present. Moreover, the computer system 1500 may comprise a networked, multi-processor computer system that may include a hybrid parallel CPU/GPU system. The CPU 1501 may execute the various logical instructions according to various embodiments. For example, the CPU 1501 may execute machine-level instructions for performing processing according to the operational flow described.

The computer system 1500 may also include computer components such as non-transitory, computer-readable media. Examples of computer-readable media include a random access memory (RAM) 1505, which may be SRAM, DRAM, SDRAM, or the like. The computer system 1500 may also include additional non-transitory, computer-readable media such as a read-only memory (ROM) 1507, which may be PROM, EPROM, EEPROM, or the like. RAM 1505 and ROM 1507 hold user and system data and programs, as is known in the art. The computer system 1500 may also include graphics processing unit(s) (GPU(s)) 1513, an input/output (I/O) adapter 1509, a communications adaptor 1521, a user interface adapter 1523, a display driver 1515, and a display adapter 1517.

The I/O adapter 1509 may connect additional non-transitory, computer-readable media such as a storage device(s) 1511, including, for example, a hard drive, a compact disc (CD) drive, a floppy disk drive, a tape drive, and the like to computer system 1500. The storage device(s) may be used when RAM 1505 is insufficient for the memory requirements associated with storing data for operations of embodiments of the present techniques. The data storage of the computer system 1500 may be used for storing information and/or other data used or generated as disclosed herein. For example, storage device(s) 1511 may be used to store configuration information or additional plug-ins in accordance with a non-limiting example of the present techniques. Further, user interface adapter 1523 couples user input devices, such as a keyboard 1527, a pointing device 1525 and/or output devices to the computer system 1500. The display adapter 1517 is driven by the CPU 1501 to control the display on a display device 1519 to, for example, present information to the user regarding available plug-ins.

The architecture of system 1500 may be varied as desired. For example, any suitable processor-based device may be used, including without limitation personal computers, laptop computers, computer workstations, and multi-processor servers. Moreover, embodiments may be implemented on application specific integrated circuits (ASICs) or very large scale integrated (VLSI) circuits. In fact, persons of ordinary skill in the art may use any number of suitable hardware structures capable of executing logical operations according to the embodiments. The term "processing circuit" includes a hardware processor (such as those found in the hardware devices noted above), ASICs, and VLSI circuits. In a non-limiting example, input data to the computer system 1500 may include various plug-ins and library files. Input data may additionally include configuration information.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

What is claimed is:

1. A coring system comprising:

a suction carrier comprising a body defining a cavity and a top portion having an aperture, the body having a length;

a pump positioned adjacent to the aperture and constructed and arranged to deliver a fluid into or from the cavity; and a corer constructed and arranged to releasably engage with the suction carrier, the corer having a length greater than the body length of the suction carrier such that when embedded within soil the corer extends to a greater depth than the suction carrier.

2. The system of claim 1 further comprising a first engagement member attached to the body and a second engagement member attached to the corer.

3. The system of claim 1 further comprising an interior pipe positioned within the cavity and attached to the top portion adjacent to a second aperture, wherein the corer is positioned within the interior pipe.

4. The system of claim 3 further comprising an actuable sealing device positioned within an annulus defined by an external surface of the corer and an internal surface of the interior pipe.

5. The system of claim 4, wherein the actuable sealing device is an inflatable seal.

6. The system of claim 3, wherein the body has a first longitudinal length and the interior pipe has a second longitudinal length, the first longitudinal length and the second longitudinal length are the same.

7. The system of claim 3, wherein the body has a first longitudinal length and the interior pipe has a second longitudinal length, the first longitudinal length is greater than the second longitudinal length.

8. The system of claim 3 further comprising a clamping member attached to the top portion, the clamping member having an engaged position in which the clamping member is mechanically engaged with the corer.

9. The system of claim 1 further comprising a control umbilical configured to operate and control the pump.

10. A method of obtaining a soil sample comprising:

providing a coring system comprising a suction carrier comprising a body defining a cavity and a top portion having an aperture, a pump positioned adjacent to the aperture and constructed and arranged to deliver a fluid into or from the cavity, and a corer constructed and arranged to releasably engage with the suction carrier;

embedding an end of the corer into soil of a seafloor to a first depth;

positioning the suction carrier on the seafloor next to the corer introducing fluid into the cavity;

engaging the suction carrier with the corer;

operating the pump to remove fluid from the cavity until the end of the corer has reached a second depth, wherein the difference between the first depth and the second depth is the amount that the suction carrier has been embedded into the soil; and retrieving the corer containing the soil sample.

11. The method of claim 10 further comprising:

releasing the suction carrier from the corer;

repositioning the suction carrier relative to the corer;

engaging the suction carrier with the corer; and operating the pump to remove fluid from the cavity until the end of the corer has reached a third depth.

12. The method of claim 10, wherein the corer is positioned within an interior pipe, the coring system further comprises the interior pipe positioned within the cavity and attached to the top portion adjacent to a second aperture, and an actuable sealing device positioned within an annulus defined by an external surface of the corer and an internal surface of the interior pipe, the actuable sealing device having an open position and a sealed position.

13. The method of claim 12 further comprising operating the actuable sealing device into the sealed position before the pump is operated to remove fluid from the cavity.

14. The method of claim 10, wherein the coring system further comprises a clamping member attached to the top portion, the clamping member having an engaged position in which the clamping member is mechanically engaged with the corer.

15. The method of claim 14 further comprising placing the clamping member in the engaged position before the pump is operated to remove fluid from the cavity.

16. A coring system comprising:

a suction carrier comprising a body defining a cavity and a top portion having an aperture, the body having a length;

a pump positioned adjacent to the aperture and constructed and arranged to deliver a fluid into or from the cavity; and a corer constructed and arranged to releasably engage with the suction carrier such that when embedded within soil the corer extends to a greater depth than the suction carrier.

17. The system of claim 16 further comprising a first engagement member attached to the body and a second engagement member attached to the corer.

18. The system of claim 16 further comprising a control umbilical configured to operate and control the pump.

* * * * *